United States Patent [19]

Bolhuis et al.

[11] Patent Number: 4,937,498

[45] Date of Patent: Jun. 26, 1990

[54] DC/AC CONVERTER FOR IGNITING AND SUPPLYING A GAS DISCHARGE LAMP

[75] Inventors: Pieter J. Bolhuis; Adrianus M. J. De Bijl; Johannes M. Van Meurs, all of Eindhoven, Netherlands

[73] Assignee: U.S. Philips Corporation, New York, N.Y.

[21] Appl. No.: 255,079

[22] Filed: Oct. 7, 1988

[30] Foreign Application Priority Data

Oct. 19, 1987 [NL] Netherlands ..... 8702488

[51] Int. Cl.[5] ..... H05B 37/00

[52] U.S. Cl. ..... 315/106; 315/240; 315/DIG. 5

[58] Field of Search ..... 315/101, 106, 225, 240, 315/DIG. 5

[56] References Cited

U.S. PATENT DOCUMENTS

| | | | |
|---|---|---|---|
| 4,010,399 | 3/1977 | Bessone et al. | 315/106 X |
| 4,647,820 | 3/1987 | Chermin et al. | 315/241 R X |
| 4,746,841 | 5/1988 | Ogawa | 315/106 X |
| 4,749,909 | 6/1988 | Smulders | 315/106 X |

*Primary Examiner*—Robert J. Pascal

*Attorney, Agent, or Firm*—Bernard Franzblau

[57] ABSTRACT

A DC/AC converter for igniting and supplying a gas discharge lamp (1) has two input terminals (C, D) intended to be connected to a DC voltage source. These input terminals are connected together by means of a series arrangement of a load circuit comprising at least the discharge lamp (1) and an induction coil (8), as well as a first semiconductor switching element (9). This load circuit being shunted by a circuit comprising a second semiconductor switching element (10). The switching elements (9, 10) are rendered alternately conductive and non conductive at a high frequency. The lamp is shunted by a third semiconductor switching element (12) which is conductive while the lamp electrodes (2, 3) are being pre-heated, whereafter the converter is rendered inoperative for a short period of time in order to ignite the lamp, which time is shorter than the time required to cool the lamp electrodes to below their emission temperature. The converter is thereafter rendered operative again.

6 Claims, 1 Drawing Sheet

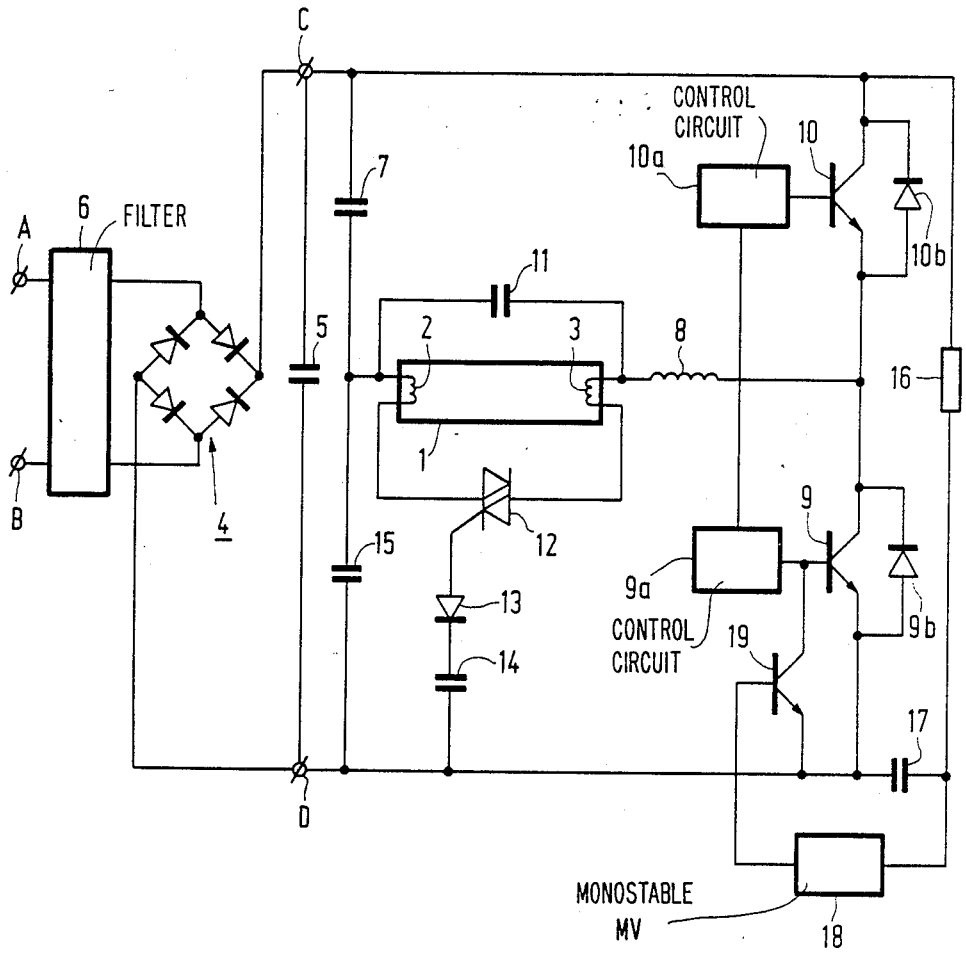
C
CONTROL
CIRCUIT
10
10a
10b
7
6
FILTER
A
11
5
2
3
8
16
1
B
4
9
12
15
9a
13
9b
CONTROL
CIRCUIT
19
14
17
D
MONOSTABLE
MV
18

DC/AC CONVERTER FOR IGNITING AND SUPPLYING A GAS DISCHARGE LAMP

BACKGROUND OF THE INVENTION

This invention relates to a DC/AC converter for igniting and supplying a gas discharge lamp. The converter has two input terminals intended to be connected to a DC voltage source, said input terminals being connected together by means of a series arrangement which includes a load circuit, comprising at least the discharge lamp and an induction coil, and a first semiconductor switching element. The load circuit is shunted by a circuit comprising a second semiconductor switching element, said switching elements being rendered alternately conductive and non-conductive at a high frequency. A converter of this type is known from the U.S. PAT. NO. 4,647,820 (3/3/87).

This U.S. Patent describes a converter of the half-bridge type in which the lamp is shunted by a capacitor and a resistor having a positive temperature coefficient (PTC). A fairly large pre-heating current then flows through the electrodes, whereafter the lamp ignites readily. A current, though small, also flows continuously through the electrodes during the lamp operation in such a converter. This is detrimental to the efficiency of the converter.

SUMMARY OF THE INVENTION

It is an object of the invention to provide a DC/AC converter having a high efficiency in which energy dissipation in the electrodes of the lamp is minimized.

According to the invention a DC/AC converter of the type described in the opening paragraph is therefore characterized in that the lamp is shunted by a third semiconductor switching element which is conductive while the electrodes are being pre-heated, whereafter the converter is rendered inoperative for a short time in order to ignite the lamp, which time is shorter than the time required to cool the lamp electrodes to below their emission temperature, whereafter the converter is rendered operative again.

The said third switching element is thus closed while the electrodes of the lamp are being pre-heated. Since the high-frequency converter is entirely rendered inoperative (for example, by short-circuiting the control of one of the (switching transistors), the third switching element is also rendered non-conducting and is subsequently not rendered conducting anymore during lamp operation. The continuous flow of a current through the electrodes during lamp operation is then avoided. The period of time during which the converter is switched off is limited by the period of time it takes for the temperature of the electrodes to drop below the electrode-emission temperature. If the converter is inoperative too long, the electrode temperature may drop to such a low value that it creates the risk of igniting the lamp on too cold electrodes. In a practical embodiment, with conventional low-pressure mercury vapour discharge lamps, this period of time is at most 10 ms.

The switching element is integrated in a DC/AC converter operated at a high frequency. Unlike, for exampele, a circuit of an electronic starter, the electrodes are preheated with relatively few elements.

In a preferred embodiment of the converter, the third semiconductor switching element is a triac, and the converter is rendered inoperative for a period of time which is longer than the recovery time of the triac.

The triac has an opportunity to be turned off. In fact, a current having a frequency which is larger than approximately 20 kHz flows through the triac during the preheating stage. This is such a high frequency that the triac is not turned off.

The period of time in which the current is interrupted is chosen so that the temperature of the electrodes is still sufficiently high upon ignition of the lamp, and that there are still sufficient ionized particles in the discharge space of the lamp. Dependent on the type of triac and the quality of the electrodes, the said period of time is between 10 /μs and 10 ms. In a practical embodiment the inoperative period of the converter covers approximately 2 ms.

BRIEF DESCRIPTION OF THE DRAWING

The invention will now be described in greater detail, by way of example, with reference to the accompanying drawing showing diagrammatically an embodiment of the converter according to the invention.

DESCRIPTION OF THE PREFERRED EMBODIMENT

In the drawing the reference numeral 1 denotes a tubular low-pressure mercury vapour discharge lamp. The lamp has two pre-heatable electrodes 2 and 3.

The terminals C and D are the input terminals of the high-frequency DC/AC converter. They are intended to be connected to a DC source which is constituted by the diode bridge 4, with capacitor 5. The bridge is connected via input filter 6 to terminals A and B across which an alternating voltage is present (220 V, 50 Hz).

The terminals C and D are connected together by means of a series arrangement of a load circuit comprising a series-arranged capacitor 7, the lamp 1, an induction coil 8 and a first semiconductor switching element (transistor) 9. The circuit comprising the capacitor 7, the lamp 1, and the coil 8 is shunted by a circuit comprising a second semiconductor switching element (transistor) 10. The free-wheeling diodes **9*b* and 10*b* are arranged parallel across transistors 9 and 10**.

The two switching elements are rendered alternatately conducting and non-conducting at a high-frequency by means of control circuits **9*a* and 10*a* (shown diagrammatically). The lamp 1 is shunted by capacitor 11 and by a third semiconductor switching element 12 (triac) which is conductive during pre-heating of the electrodes 2 and 3. The control electrode of the triac 12 is connected to terminal D via a series arrangement of a diode 13 and a capacitor 14. The junction point of the lamp 1 and the capacitor 7 is also connected to terminal D via capacitor 15**.

The series arrangement of the two semiconductor switching elements 9 and 10 is shunted by a series arrangement of a resistor 16 and a capacitor 17. The junction point of elements 16 and 17 is connected to a monostable multivibrator 18 which is connected to the base of a switching transistor 19 arranged between the control electrode and the emitter of switching element 9.

After the lamp electrodes have been pre-heated, the converter is rendered inoperative for a short period of time (approximately 2 ms) with the aid of the elements 13, 14, 16, 17 and thereby 18 by turning on the transistor 19 and short-circuiting the control of the switching element 9. Coupling of control circuit **9*a* with the control circuit 10*a*** (for example, via a transformer, see U.S.

Pat. No. 4,647,820) results in control circuit 10a also being turned off. This coupling is diagrammatically shown by means of a line between 9a and 10a in the drawing. The short-circuit time is shorter than the time which is required to cool the lamp electrodes to below the emission temperature. If the short-circuit of transistor 9 is eliminated again (and high-frequency switching of the converter is started again, for example, by means of a starting pulse with a diac, see also U.S. Pat. No. 4,647,820) the lamp does not ignite on too cold electrodes. The required time for the triac to be turned off (by rendering the converter inoperative) should be at least 10 /μs, dependent on the type.

The circuit operated as follows. After connecting the terminals A and B to the A.C. power supply, the capacitors 7 and 15 are charged via bridge 4. The converter is started via a starter circuit (not shown). The triac 12 is rendered conducting via diode 13 and capacitor 14 and the electrodes 2 and 3 are pre-heated. Since elements 9 and 10 switch at a high frequency, a high-frequency current flows through triac 12. The voltage across capacitor 17 increases above the threshold value of the monostable multivibrator 18, which in turn applies a pulse to the base of transistor 19 which is then turned on and short-circuits the control of transistor 9. The converter is then inoperative for 2 ms. Then the pulse stops and the switches 9 and 10 are rendered alternately conducting and non-conducting via the starter circuit. Triac 12 is then no longer turned on because the capacitor 14 is charged. When the converter switches on again, no current flows through the gate of triac 12 due to the reverse bias provided by the voltage on capacitor 14.

In one embodiment the most important circuit elements had the followign values:

capacitor 5: 10 /μF
capacitor 7: 0.5 /μF
capacitor 15: 0.5 /μF
capacitor 11: 12 nF
capacitor 14: 100 nF
coil 8: 2 mH.

The discharge lamp was a tubular low-pressure mercury vapour discharge lamp (approximately 1.20 m) having a power of 32 W. The two semiconductor switching elements 9 and 10 are of the BUT11 type (Philips). The triac 12 was a BT136 (Philips).

What is claimed is:

1. A DC/AC converter for igniting and supplying a gas discharge lamp comprising: two input terminals for connection to a DC voltage source, means connecting said input terminals together by means of a series arrangement of a load circuit comprising at least the discharge lamp and an induction coil, as well as a first semiconductor switching element, said load circuit being shunted by a circuit comprising a second semiconductors switching element, means for driving said switching elements to be alternately conductive and non-conductive at a high frequency, characterized in that the lamp is shunted by a third semiconductor switching element which is conductive while the lamp electrodes are being pre-heated, whereafter the converter is rendered inoperative for a short period of time in order to allow ignition of the lamp, which time period is shorter than the time required to cool the lamp electrodes to below their emission temperature, whereafter said driving means makes the converter operative again.

2. A DC/AC converter as claimed in claim 1, wherein the third semiconductor switching element is a triac having a characteristic recovery time and the converter is rendered inoperative for a period of time which is longer than the recovery time of the triac.

3. A DC/AC converter as claimed in claim 1, further compricing a diode and a capacitor connected in series circuit between a control electrode of the third semiconductor switching element and one of said two input terminals.

4. A DC/AC as claimed in claim 3, further comprising first and second capacitors connected in a series circuit across said two input terminals and with a junction point therebetween connected to said load circuit, and a resistor and a third capacitor connected in a further series circuit across said two input terminals.

5. A DC/AC converter as claimed in claim 4, wherein said first and second semiconductor switching elements comprise first and second transistors connected in a series circuit across said two input terminals, said converter further comprising:

a third transistor connected across a control path of one of said first and second transistors, and a trigger circuit controlled by a voltage developed across the third capacitor to control in turn conduction of said one transistor.

6. A DC/AC converter as claimed in claim 1, further comprising a resistor and a capacitor connected in a series circuit across said two input terminals, and wherein said first and second semiconductor switching elements comprise first and second transistors connected in a series circuit across said two input terminals, said converter further comprising:

a third transistor connected across a control path of one of said first and second transistor, and a trigger circuit controlled by a voltage developed across the capacitor to control in turn conduction of said one transistor.

* * * * *